United States Patent [19]

Lehmann et al.

[11] 4,206,508

[45] Jun. 3, 1980

[54] ELECTRIC TEST SET FOR ACOUSTIC TORPEDO HOMING SYSTEMS

[75] Inventors: Emil W. Lehmann, Princeton, N.J.; Harvey Brooks, Cambridge, Mass.; Jack H. Slaton, Arcadia, Calif.

[73] Assignee: The United States of America as represented by the Secretary of the Navy, Washington, D.C.

[21] Appl. No.: 785,765

[22] Filed: Jan. 8, 1959

[51] Int. Cl.[2] ..... H04B 17/00

[52] U.S. Cl. ..... 367/13; 114/23

[58] Field of Search ..... 114/20, 21.1, 23; 367/13

[56] References Cited

U.S. PATENT DOCUMENTS 2,522,541 9/1950 Saxton ..... 244/14.6

2,704,644 3/1955 Good ..... 244/14.6

*Primary Examiner*—Richard A. Farley

*Attorney, Agent, or Firm*—R. S. Sciascia; Henry Hansen

EXEMPLARY CLAIM

1. In a device for testing torpedo acoustic homing systems the combination comprising: first means for providing a plurality of output voltages having substantially equal amplitudes and adjustable predetermined relative phase relationships adapted for connection with a torpedo acoustic-homing system, second means for supplying an electrical signal having substantially the same characteristics as an acoustical signal received by an underwater transducer to said first means; and indicating means adapted for monitoring the operation of said homing system whereby the response of said homing system to said output voltages of said first means is pointed out.

5 Claims, 8 Drawing Figures

ELECTRIC TEST SET FOR ACOUSTIC TORPEDO HOMING SYSTEMS

This invention relates to test sets and more particularly to test sets for acoustic torpedo homing systems of the type utilizing four electric signals obtained from four quadrents of an electro-acoustic transducer.

It is well known to provide acoustic responsive devices or sound ranging systems for torpedoes which receive noise from propellers or other sound sources of a target vessel and utilize this received energy to orient the path of travel of the torpedo in the direction from which the sound is received. It is also well known to provide homing devices for torpedoes which detect the presence of an object by echo-ranging means which transmit energy intermittantly into the water and between transmission periods receive echo signals which are compared for horizontal and vertical guidance by utilizing split-lobe steering characteristics of the receiver.

This invention may be used, for example, to test acoustic homing systems and components of the type disclosed in the patent application of Harvey Brooks, Ser. No. 240,213, filed Aug. 3, 1951, entitled TORPEDO ECHO STEERING SYSTEM, now Pat. No. 3,024,755 and in particular to test acoustic homing systems utilizing input systems of the type disclosed in the patent application of Harvey Brooks, Ser. No. 263,807, filed Dec. 28, 1951, entitled BALANCED INPUT SYSTEM, now Pat. No. 3,025,493. This invention may also be used with equal facility to test acoustic homing systems of the combined active and passive types, which, for purposes of exaplanation, may be considered a system adapted for either active or passive operation as may be desired.

Acoustic torpedo homing systems are as a general rule quite complicated and sensitive to variations in tolerances, aging, misalignment and the like. For this reason it is essential that during and after production such systems be tested to determine if they are operable within specified limits and that they be tested in the field for repair purposes and prior to actual use to insure that the system is an operable condition.

The electronic panel of a torpedo acoustic homing system is an electronic device which is intended to serve as a link in the acoustic torpedo homing system. The types of electronic panels here concerned have a signal input of four electrical signals obtained from four quadrents of an electro-acoustic transducer. The output signals of the electronic panel control "steering relays" determine the position of the torpedo's steering surfaces. During operation of the system, the position of the steering surfaces resulting from the steering-relay throws are such as to direct the torpedo in the direction of the source of the acoustic signal, which direction the transducer supplied to the panel in electrical form.

The primary function of the invention is to provide a means for checking quantitatively the operation of the electronic panel as a unit, by providing electrical signals having specific characteristics at the panel input, and providing means of monitoring the action of the steering relays or means which control the action of the steering surfaces.

The invention furnishes, at the panel input, signals which substantially simulate actual signals which appear at the torpedo transducer output so that proper response of the panel to the simulated signal will guarantee proper operation of the panel in actual use. The invention provides signals for active-operation tests which are characterized by time-varying reverberation amplitiude, adjustable reverberation frequency, range-adjustable echoes, adjustable echo doppler, adjustable echo-to-reverberation amplitude ratio, adjustable apparent target position, and synchronism with panel transmission and sampling. For passive-operation tests, a signal simulating noise of a specific center of frequency and bandwidth, of adjustable amplitude and of adjustable apparent target position is provided.

It is a principle object of the invention to provide means for quantitatively testing acoustic torpedo homing systems.

Another object of the invention is to allow quantitative testing of acoustic torpedo homing systems adapted for passive operation.

A further object of the invention is to allow quantitative testing of acoustic torpedo homing systems adapted for active operation.

A still further object of the invention is to provide means for facilitating repair of inoperative or malfunctioning acoustic torpedo homing systems.

These and other objects and features of the invention, together with the incident advantages, will be more readily understood and appreciated, from the following detailed description of the preferred embodiment thereof selected for purposes of illustration and shown in the accompanying drawings, in which:

FIG. 1 is a block diagram of the test set.

FIGS. 2–3 arranged sequentially comprise a schematic diagram of the echo reverberation channel.

Figure 4:
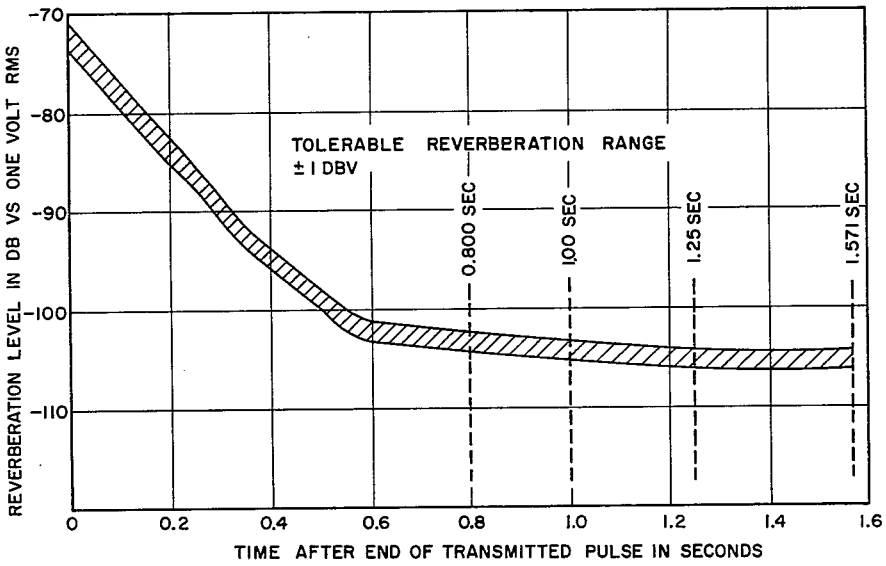
FIG. 4 is a diagrammatic representation of the reverberation level time characteristic of a transmitted pulse.

In order to perform the functions referred to immediately hereinabove, the test set provides electric tests signals and energizing potentials to the electronic panel so that over-all operational tests of the panel may be made. The general nature of such tests consists of the application of various specified signals to the panel inputs and monitoring of the operation of the steering relays.

For passive-operation checks, the test set performs the basic function of supplying a test signal simulating the electrical output of a torpedo transducer in passive operation. This function consists of supplying noise in the transducer bandwidth, of variable amplitude and of variable simulated target angle, supplied from a source of transducer impedance, and of monitoring operation of the necessary relays.

For active-operation checks, the test set performs the basic functions of performing at a fixed repetition rate the pulsing functions normally performed by the torpedo pulse timer, supplying a load to dissipate the transmitted-pulse power of the torpedo transmitter, supplying a test signal simulating transducer electrical output in active operation wherein simulated range, doppler, target angle, and amplitude relative to reverberation of the echo is adjustable and wherein during each cycle of the pulser, the signal consists of decaying reverberation plus an echo; monitoring of the various functions of the panel; and controlling operation of the necessary relays in the panel.

The functions required of the test set for active and passive operation checks makes it possible to determine whether or not the given panel meets its requirements; hence if a panel does not fully meet its requirements, the particular test in which it fails is indicative of the source of trouble. In view of this it follows that a trouble-shooting procedure may consist of applying the tests necessary for active and/or passive operation checks and of substituting good assemblies for suspected ones when the panel fails to meet one of its requirements.

The test set must meet the electrical requirements of the panel being checked and the functional requirements referred to immediately hereinabove in terms of power input, signal inputs, test-set connections to electronic-panel relays, relay-operating outputs, visual information outputs, signal outputs, and electronic-panel-energizing power output.

This is accomplished by adapting the test set to be supplied from a suitable power source such as, for example, 110 volts-60 cps. The test set is connected to the input and output terminals of the panel by suitable cables to supply the necessary input signals to the panel and to allow monitoring of the necessary functions of the panel such as, for example, the operation of holding, gating, and steering relays.

The output of the panel may be visually displayed by pilot lights that indicate operation of the steering relays (right, left, up, down) gating relays and the like.

The output signals of the test set simulate reverberation by means of a pure tone signal having substantially the same frequency as that of the panel, the cycle beginning simultaneously with the trailing edge of the transmitted pulse, and within the total reverberation range.

Echoes are simulated by providing an electrical signal providing one echo per transmitted pulse, having an echo frequency (without doppler) within about plus or minus 4 cps of the reverberation frequency selected, having an echo doppler frequency continuously variable over plus or minus 100 cps about the echo frequency, being discretely adjustable for doppler shift of about 800±75 cps about the echo frequency, having a duration equal to that of the transmitted pulse, and an adjustable magnitude with regard to reverberation level. Additionally, means are provided to provide selectable echo delays of a predetermined length of time and to allow adjustment of the signal to simulate target angles of the echoes in one-degree steps from 0 to 6 degrees at orientation angles every 45 degrees from zero degrees to 315 degrees.

Passive operation is simulated by providing an electric signal having an adjustable magnitude, substantially the same frequency as the transmitter, a 3-db bandwidth of 4.5 kc plus or minus 500 cps, and adjustable to simulate target angles adjustable in one-degree steps from 0 to 6 degrees at orientation angles every 45 degrees from zero degrees to 315 degrees.

The necessary power requirements may be easily met by the provision of a conventional power supply for supplying the necessary electrical requirements of the test set and the panel as may be required.

Figure 1:
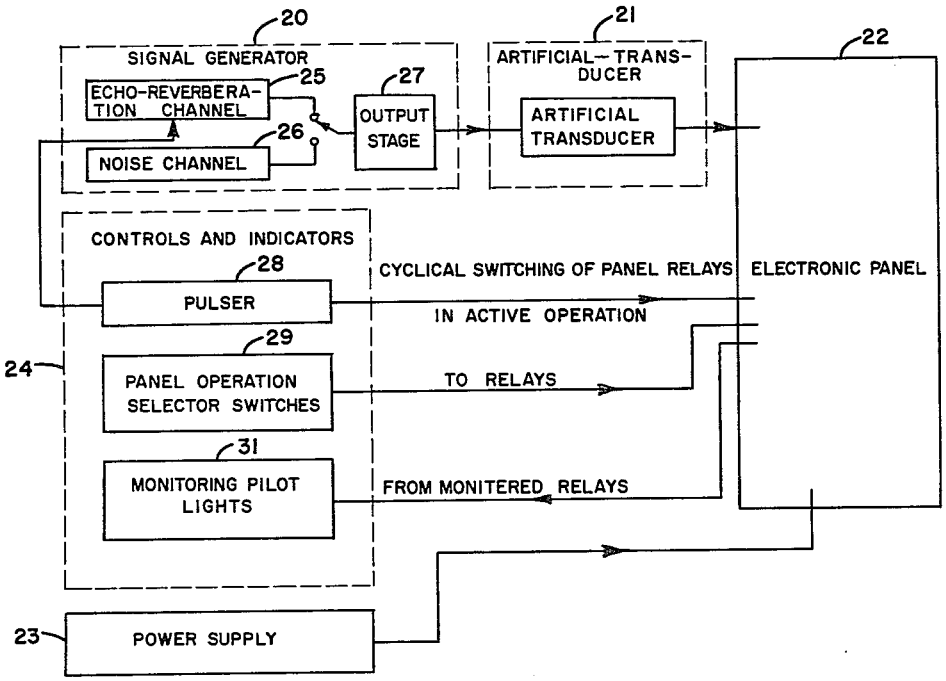

With reference now to FIG. 1, the present invention involves in its preferred embodiment a signal generator 20 for simulating acoustic signals received by a transducer in either active or passive operation, an artificial transducer 21 adapted for connection to the electronic panel 22 of the torpedo acoustic homing system for supplying a test signal simulating the electrical output of a four quadrent transducer, a power supply 23 for supplying the necessary voltages to the test set and the electronic panel 23, and controls and indicators 24 adapted for connection to the electronic panel 23 and the signal generator 20 for controlling the operation of the test set and the electronic panel and visually indicating panel operation. As shown in FIG. 1, the signal generator 20 is comprised of an echo-reverberation channel 25, a noise channel 26, and an output stage 27 for supplying a test signal simulating respectively an acoustic signal as would be received by the torpedo transducer in active operation and an acoustic signal as would be received by the torpedo transducer in passive operation. The controls and indicators 24 are comprised of a pulser unit 28, panel operation selector switches 29, and monitoring pilot lights 31. The echo-reverberation channel 25 which provides the test signal for active operation tests will now be described followed by a description of the noise channel 26 which provides a test signal for passive operation tests.

Figure 2:
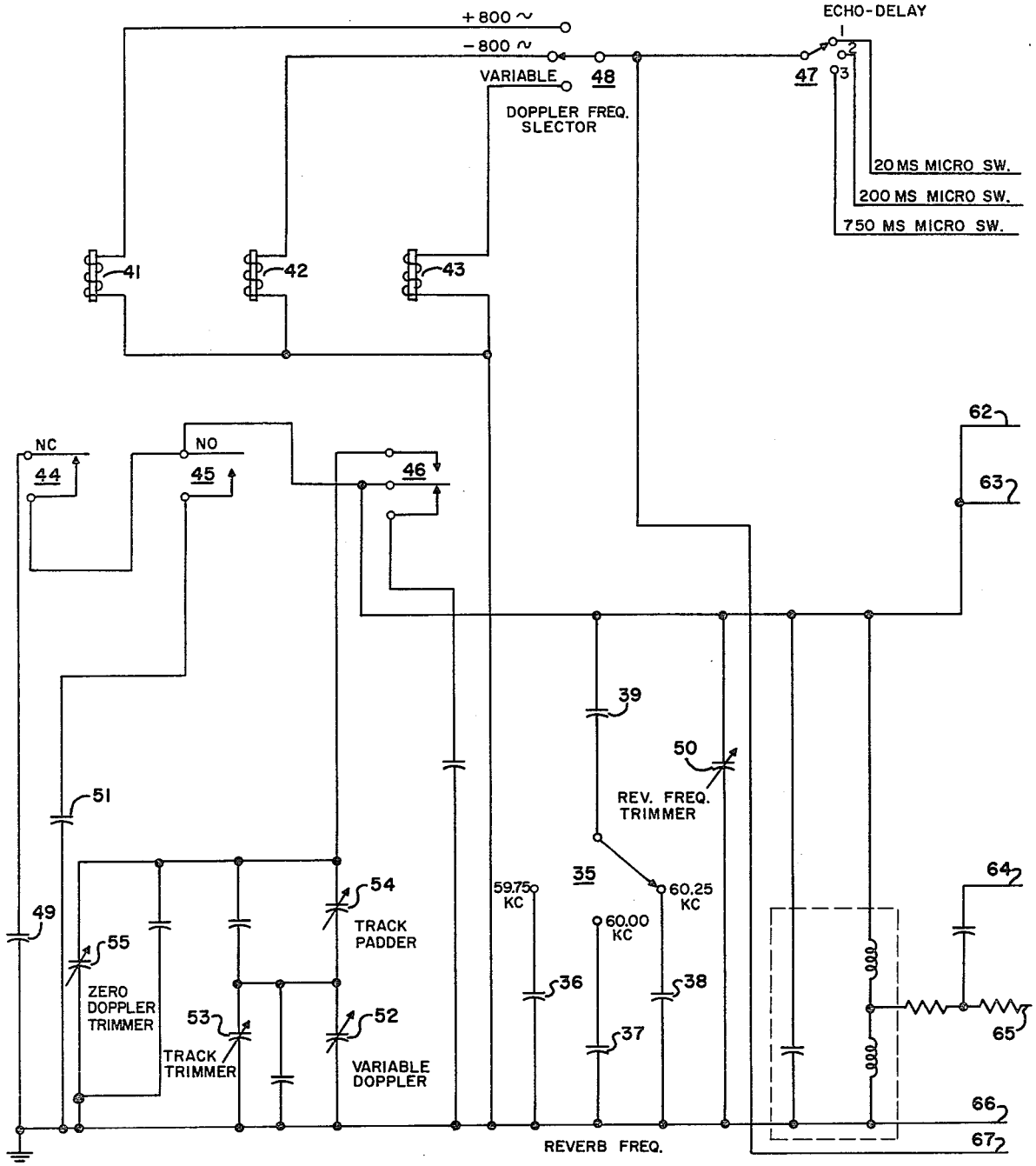
Figure 3:
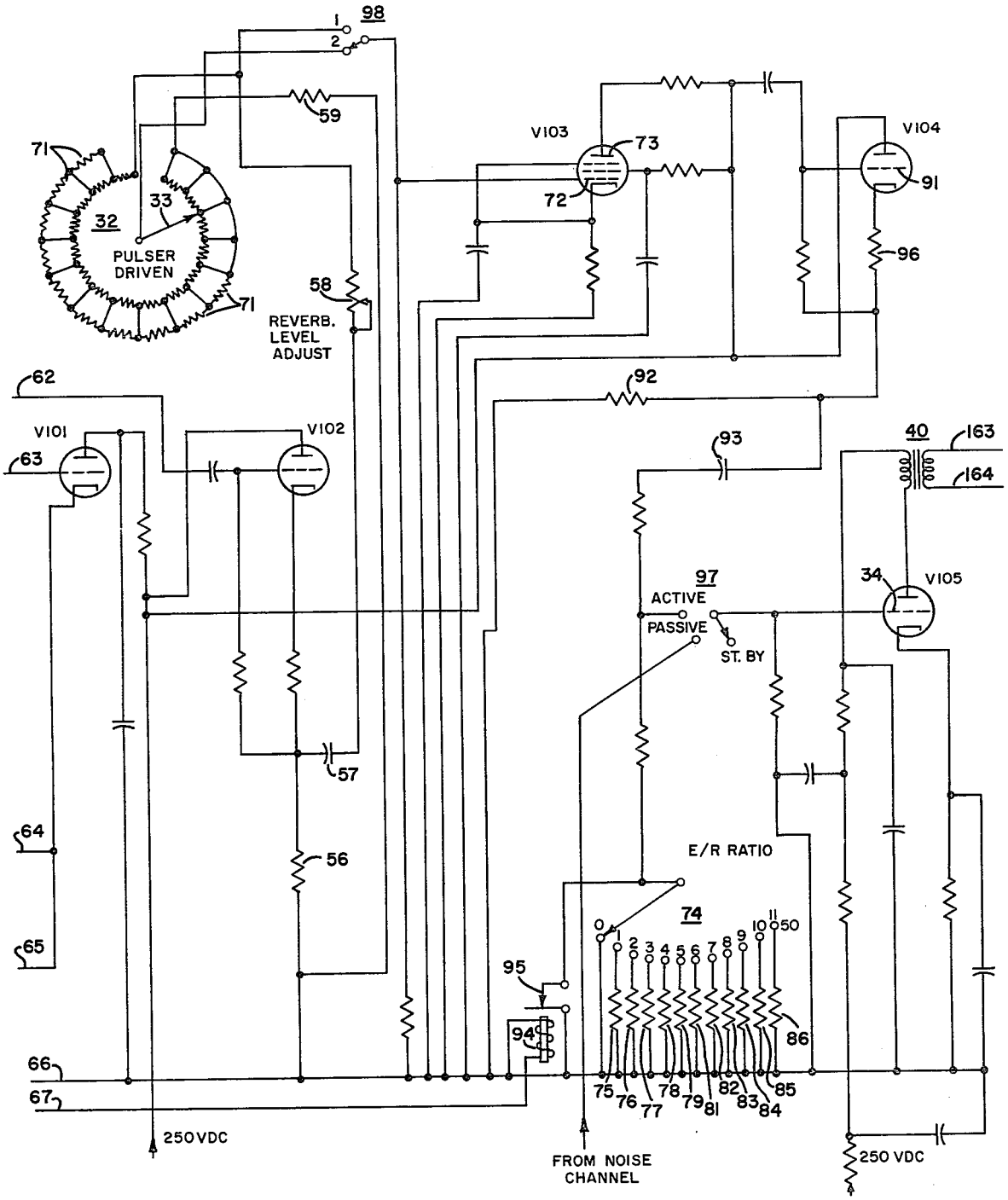

With reference now to FIG. 2, FIG. 3, and FIG. 4 the characteristics of the test signal for active operation as indicated hereinbefore are obtained in the following manner. The amplitude and frequency of the signal, at any time after the transmitter pulse interval, are synchronized with respect to the transmitted pulse by cam-operated microswitches and the reverberation-characteristic-generating potentiometer which are a part of the test-set pulser unit 28 more completely described hereinafter. Reverberation is simulated by a pure-tone signal and an echo is simulated by shifting the frequency of the reverberation for the duration of the echo period by an amount corresponding to the desired doppler shift and simultaneously altering the amplitude of the pure-tone signal during this period. The pure-tone signal is supplied by a conventional Hartley oscillator comprising vacuum tube V101 with switched tuning capacitors more thoroughly described hereinafter. The output signal of the oscillator is supplied to vacuum tube V102 connected as a cathode follower which supplies the oscillator output signal to the reverberation-characteristic potentiometer 32 which is located in the pulser unit 28 and rotated continuously in synchronism with the cyclical switching operations performed by the pulser unit. The level of the signal out of the reverberation potentiometer 32 at any instant (see FIG. 4) is determined by the position of the potentiometer wiper 33 at that instant, and this level is amplified by a conventional voltage amplifier comprising vacuum tube V103. The test signal from vacuum tube V103 is supplied to vacuum tube V104 connected as a cathode follower and echo-relay switching operations in the cathode circuit of V104 inject the desired echo-to-reverberation ratio by means of a voltage divider circuit described more thoroughly hereinafter, after which the test signal is applied to the grid 34 of the output stage 27 comprising vacuum tube V105 and transformer 40.

Three reverberation frequencies of respectively a central frequency of 60 kc plus or minus 150 cps, and two frequencies separated from the center frequency by plus and minus 250 cps, ±25 cps, are provided by a switch 35 and selectable capacitors 36, 37, 38 in series with a fixed capacitor 39, the series combination being connected across and comprising a part of the oscillator tank of the oscillator. Variable reverberation frequency trimmer capacitor 50 is provided to allow adjustment of the reverberation frequencies.

Doppler deviation from any one of the three reverberation frequencies referred to immediately hereinabove is provided for three different values: two fixed values of plus and minus 800 cps, ±75 cps; and a continuously variable range of plus 100 cps to minus 100 cps about the reverberation frequency selected by switch 35. The frequency deviations are obtained by shifting the frequency of the oscillator by means of relays 41, 42, 43, which are actuated through the proper microswitches in the pulser, the operation of the relays 41, 42, 43, acting through respectively normally closed contacts 44, normally open contacts 45, and contacts 46 to switch the necessary capacitance into and/or out of the tank circuit of the oscillator during the echo interval. Selection of the desired microswitch is obtained by the echo delay switch 47 and actuation of the selected microswitch by the pulser supplies current through the echo delay switch 47 and the doppler frequency selector switch 48 to the selected relay, actuation of the contacts of which connect capacitors 49, 51, 52, across the tank circuit of the oscillator to provide the necessary frequency, adjustment of variable capacitor 52 acting to vary the capacitance in the tank circuit such as to provide the continuously variable range of plus 100 cps to minus 100 cps about the reverberation frequency selected by means of adjustment of switch 35.

Three separate relays 41, 42, 43, are used to obtain the desired doppler deviation frequency, excitation being provided to only one relay at a time to prevent variations of the reverberation frequency, about which the doppler deviations appear, when selecting one or another doppler frequency, as would occur, due to differences in stray wiring capacitances to the different capacitors, if a single relay and a switch were used to select the different capacitors to obtain the desired frequency deviations. For the embodiment shown and described herein stray wiring capacitances for each doppler capacitor 49, 51, 52, and their respective relays 41, 42, 43 are continuously present, hence variation of reverberation frequency with selection of echo doppler is avoided. Although the actual shift in frequency is different for the three possible reverberation frequencies with a given doppler-shift capacitor, the variation in doppler shift caused by switching from one to another of the reverberation frequencies is within the hereinbefore specified tolerances both for the continuously variable doppler and for the discrete dopplers of plus and minus 800 cps.

In order that the constantly variable doppler be accurate and readable to ±4 cps, a conventional tracking arrangement of a high-end trimmer capacitor 53 and a low-end padder capacitor 54 is provided in the variable doppler circuit. The tracking procedure for the oscillator is preferably carried out as a "factory" adjustment after construction and thereafter trimmer 53 and padder 54 immediately sealed. Service alignment for variable doppler is provided by a trimmer capacitor 55 which may be adjusted, with the variable doppler capacitor 52 set for zero, until the echo frequency is the same as the reference frequency such as, for example, 60 kc. The reverberation frequency may, if desired, be zero-beat with the reference frequency so that the zero-doppler and reverberation frequencies will be the same. With the "zero" of the doppler frequency known to be correct, tracking over the rest of the plus and minus 100 cps range will fall within the aforementioned tolerances with the original tracking adjustment unchanged.

The output of the echo-reverberation oscillator, at whatever instantaneous frequency is determined by the reverberation and doppler frequency controls, 35, 48, is supplied to vacuum tube V102 which is connected as a cathode follower to provide a proper impedance match and which in turn supplies the signal to the reverberation potentiometer 32 which has a continuous mechanical rotation of 360 degrees and a continuous electrical rotation of 357 degrees. The AC load on vacuum tube V102 consists of resistor 56 in parallel with a series combination of capacitor 57, resistor 58, the reverberation potentiometer 32, and resistor 59. The desired reverberation amplitude-vs-rotation characteristics may be obtained mechanically, for example, by connecting the reverberation potentiometer 32 in series with variable resistor 58 and connecting shunting resistors 71 of the proper value across discrete portions of the potentiometer such that the reverberation-vs-angular-rotation characteristics of the potentiometer and resistor 58 gives the desired reverberation amplitude-vs-rotation characteristic, condenser 57 being provided to avoid DC transients when the potentiometer slider 33 goes through electrical zero, the shunting resistors referred to hereinabove being selected on the basis of a fixed repetition period or cycle of, for example, 1.25 seconds.

The signal from the slider 33 of the reverberation potentiometer 32 is applied to the grid 72 of vacuum tube V103 which is connected as a conventional pentode amplifier and which provides approximately 40 db of amplification. The signal level at the grid 72 of vacuum tube V103 may vary from about minus 15 dbv to minus 48 dbv during the listening interval, and at the plate 73 the range may be approximately plus 25 dbv to minus 8 dbv for the repetition period of 1.25 seconds.

The only operation not yet described which is performed in the echo-reverberation channel 25 is the provision of an amplitude differential, at a selectable ratio, which is coincident with the period during which the reverberation frequency is shifted as described hereinbefore to simulate doppler-shift of the echo. A choice of echo-reverberation amplitude ratios of 1 to 10 db in 1 db steps, plus a ratio of 50 db is provided by switch 74 and resistors 75–86.

It is preferable that the 50 db echo-reverberation ratio be used only for ranges greater than that corresponding to a 750 millisecond delay where the reverberation level is down about 30 db from the zero-time reverberation level. If such is observed the dynamic range of the echo-reverberation channel 25 need not be provided for a full 50 db differential above the zero-time reverberation level.

The echo-to-reverberation ratios are provided by supplying the signal from the output circuit of vacuum tube V103 to the grid 91 of vacuum tube V104 which is connected as a cathode follower. The AC load on vacuum tube V104 is comprised of resistor 92 in parallel with a series combination of capacitor 93 and an adjustable voltage divider comprised of switch 74, resistors 75–86, and echo relay 94, the selectable part of the voltage divider being shorted out by normally closed contacts 95 of the echo relay 94 except during an echo period. Whenever current is supplied to any one of the doppler relays 41, 42, 43 to introduce a doppler shift, current is simultaneously supplied to the echo relay 94 to cause the normally closed contacts 95 to open hence, the ratio of the voltage divider goes up by an amount determined by the value of the particular resistor selected by the echo-reverberation-ratio selector switch which resistors are selected to give the desired echo-reverberation amplitude ratios. The attenuation of the voltage divider from the junction of resistor 96 and 92 to switch 97 is preferably approximately 53 db when zero E/R ratio is selected. Amplitude shift during the echo period is initiated by opening rather than closing relay contacts 95 to minimize the presence of transients on the leading edge of the echo signal due to relay bounce.

Reverberation level adjust potentiometer 58 is provided in the output circuit of vacuum tube V102 to permit adjustment of the absolute level of the composite output signal of vacuum tube V102 at the desired level. The output signal of vacuum tube V102 is supplied to vacuum tube V105, which is to say the input to the artificial transducer, when the function selector switch 97 is placed in the ACTIVE position and switch 98 is thrown to its position opposite of that shown in FIG. 3.

The output stage 27 of the echo-reverberation channel 25 is comprised of vacuum tube V105 and transformer 40, switch 97 providing means for selecting either the active or passive signal. The output stage 27 matches either the active signal or passive signal, without distortion, to the input impedance of the artificial transducer 21. The peak signal required across the output load resistance of the output stage 27 is about 7 dbv or 2.3 volts rms, the output stage as shown in FIG. 3 having no serious distortion at this level. When active operation is selected, the maximum signal is not limited by the output stage and is limited only by the largest signal which vacuum tube V103 can pass without distortion.

The test signal required for passive operation tests must consist of random noise filtered to match the torpedo transducer bandwidth and be adjustable in amplitude, such as, for example, have a bandwidth of 4.5 kc ±500 cps at the 3-db downpoints centered at 60.0 kc ±300 cps and be adjustable in a range of −4 db to +6 db in 1-db steps about a threshold reference level in the range −106 dbv to −126 dbv, and also at a fixed level of −50-dbv rms.

It was found that an unstable thyraton noise-generator circuit was not suitable for supplying a reference noise signal voltage constant within ±1 db unless its output voltage was continuously monitored and adjusted due to the fact that there exists a substantial variation of about 40 db in output level for circuits of the unstabilized type resulting from tube selection, tube aging, variation in operating potentials, and variations in the ambient temperature. Attempts to find a simple and direct control characteristic for a circuit of the unstabilized type were unsuccessful. The noise generator shown in FIG. 5 and described hereinafter meets all of the requirements for a noise generator having the characteristics described hereinabove and includes a delayed AGC amplifier which maintains a constant output level for the expected range of input level variations irrespective of tube selection, tube aging, operating potentials and ambient temperature. The noise generator is comprised briefly of a thyraton noise-tube, a filter amplifier for providing the desired bandwidth and center frequency, a delayed AGC amplifier, a linear amplifier for amplifying the output signal of the AGC amplifier, a delayed voltage doubler for controlling the AGC amplifier, and a cathode follower for isolating the linear amplifier from the output stage 27 located in the echo-reverberation channel.

Figure 5:
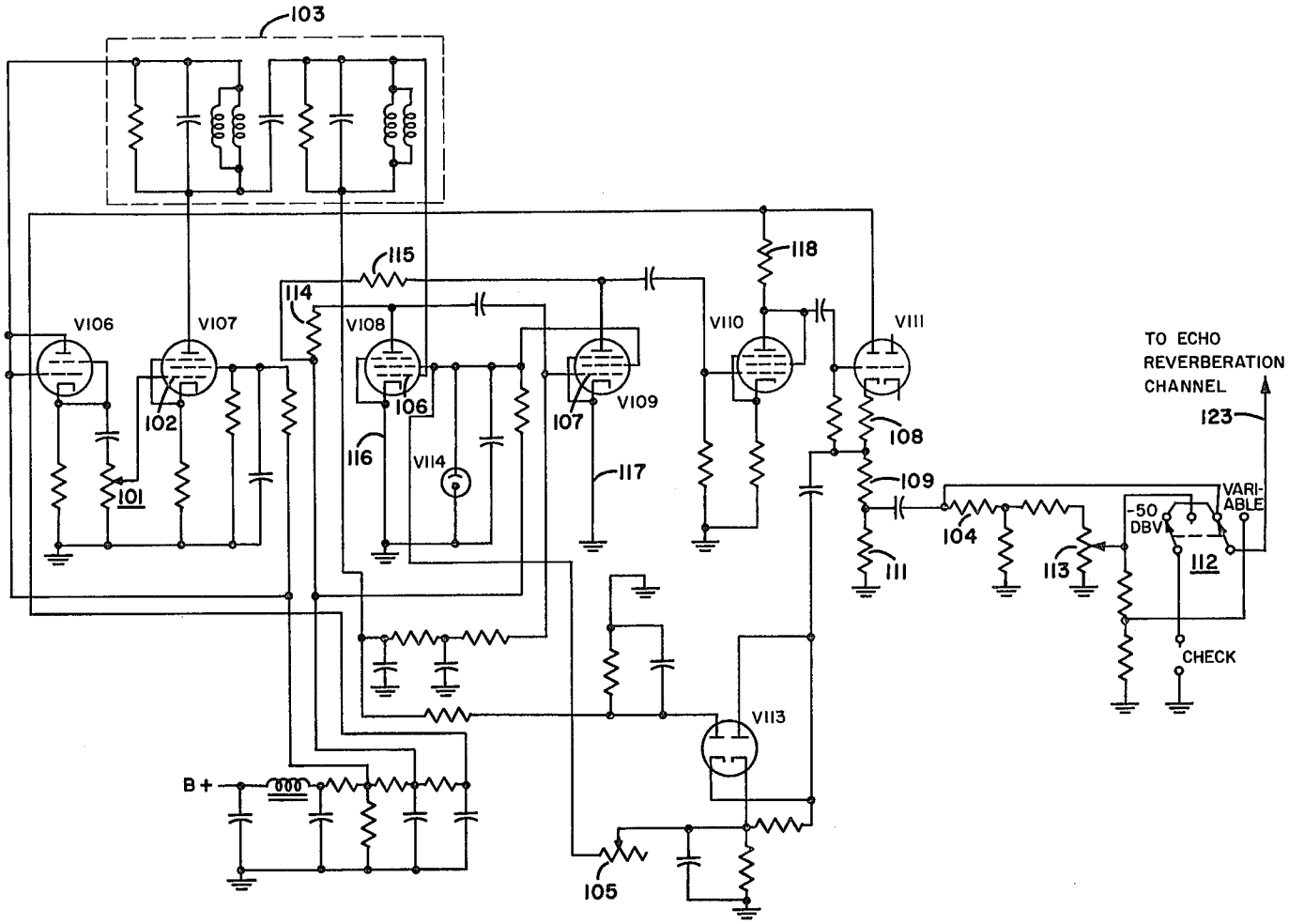
FIG. 5 is a schematic diagram of noise channel.

The schematic of the noise-generator is shown in FIG. 5. Noise voltage is developed across the cathode load of vacuum tube V106 which may be, for example, a 2D21 thyraton noise tube, and is adjustably coupled through potentiometer 101 to the control grid 102 of vacuum tube V107. Vacuum tube V107 and the filter 103 comprise a filter-amplifier having a bandwidth at the half power points of 4,500±500 cps centered at a frequency of 60,000±300 cps. After filtering by filter 103 the noise signal is amplified through the delayed AGC amplifier comprised of vacuum tubes V108 and V109 and thereafter further amplified by the linear amplifier comprised of vacuum tube V110. A cathode follower comprised of vacuum tube V111 provides isolation from the output of vacuum tube V110 and an impedance step-down to the 500 ohm T attenuator 104 and to the gaincontrol voltage circuit comprising vacuum tube V113 which is connected as a delayed voltage doubler and which obtains its delay voltage from a voltage divider connected across gas tube V114 such as, for example, an OA2 voltage regulator tube. Variable resistor 105 is provided so that the delay voltage may be set to the desired value and so that a negative output voltage is developed by vacuum tube V113 and applied to the control grids 106–107 of vacuum tube V108 and V109 whenever the noise signal at the grid of vacuum tube V111 tends to exceed a voltage of approximately 10 volts rms.

The resistors 108, 109, 111, forming the voltage divider in the cathode circuit of vacuum tube V111 should preferably be selected to give a reading on a Ballantine 300 voltmeter of −14 dbv across the output load of vacuum tube V105 when switch 112 is in the −50 dbv position and switch 97 (see FIG. 3) is in the PASSIVE position. Potentiometer 113 is provided to present a 500 ohm termination to the 500 ohm T attenuator 104 and to permit adjustment of the noise signal level across the output load of vacuum tube V105 to a value of −82 dbv when the T attenuator 104 is at its zero position and switch 112 is in the VARIABLE position. T attenuator 104 is variable to permit a 10-db variation in 1-db steps or as may be required of the variable signal.

The AGC amplifier is of conventional design having a "flatness factor" characteristic similar to that described by A. W. Nolle in the Proceedings of the IRE, 1948, and meets the requirements that the noise output by symmetrical (have both positive and negative portions), that the peaks be about 10 db above the rms value of the noise level, and that it have a flatness factor of about 40. Such requirements are met by utilizing 6AU6 tubes for vacuum tubes V108, V109, and V110, providing plate load resistors 114 and 115 of respectively 2,200 ohms and 15,000 ohms, and connecting the cathodes 116–117 of respectively vacuum tubes V108 and V109 directly to ground so that the only bias developed on them will be the negative voltage supplied from the rectifier circuit and vacuum tube V113. Provision of a plate load resistor 118 of 33,000 ohms and a cathode bias of approximately −1.3 volts for vacuum tubes V110 provides a gain of approximately 20 db with a symmetrical signal-noise output. A flatness factor of 40 is provided by vacuum tube V113, such as, for example, a 6AL5 tube, which forms a part of the voltage doubler circuit having a time constant of approximately 2 seconds, and gas tube V114 such as, for example, a VR150 tube, which maintains the screen grid potential on vacuum tubes V108 and V109 constant for all levels of bias used.

The output signal of the noise generator is taken at switch 112 and supplied to switch 97 in the echo-reverberation channel by conductor 123, vacuum tube V105 acting as the power amplifier output stage for the signal-noise generator when switch 97 is in the PASSIVE position.

The preferred embodiment of the artificial transducer forming a part of this invention simulates the torpedo transducer in reception by providing four separate signals with respect to ground, which can be varied in relative phase while all four are kept equal in amplitude. The four signals are variable in amplitude simultaneously to simulate various target sizes and ranges and are adapted to have the same phase relationships to each other that are found in the signals at the output terminals of a torpedo transducer receiving a pressure signal from a source at a given bearing.

It is well known that the signals at the terminals of a torpedo transducer can be such as to represent a target at any angular deviation from the axis of the transducer, regardless of the target orientation angle. For completeness in testing it may be desirable that the artificial transducer be able to simulate signals requiring steering not just in one plane but in two planes simultaneously, or, better yet, in any degree of variation from one plane to another. The preferred embodiment of the artificial transducer as shown and described herein simulates signals from a target at fixed orientation angles in two planes, which simulated signals have been found entirely satisfactory for all practical purposes. It is to be understood, however, that the present invention is not limited to the simulation of targets at fixed orientation angles and that the artificial transducer shown and described herein may, with suitable modifications be adapted to provide continuously adjustable orientation angles.

Figure 6:
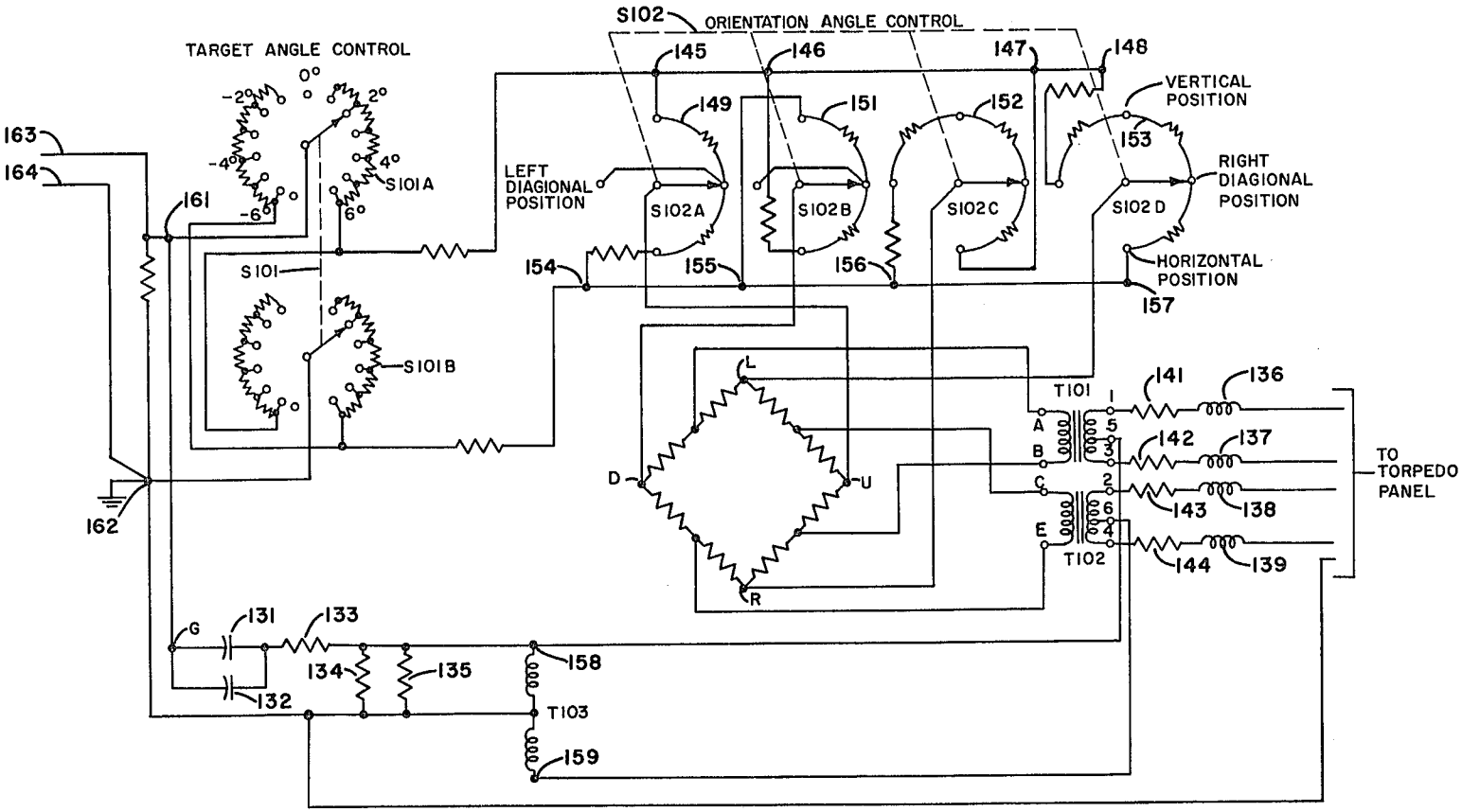
FIG. 6 is a schematic diagram of the artificial transducer.

The theory of operation underlying the artificial transducer as shown in FIG. 6 is based on the conversion of amplitude differences to phase difference. Briefly, four in-phase input signals are applied to the bridge terminals in FIG. 6 designated as L, D, R, and U, while a signal is applied to terminal G in phase with the others but of an amplitude equal to a known factor times the arithmetic mean of the voltages at terminals L, D, R, and U. The capacitors 131–132, resistor 133, and resistors 134–135 form a 90-degree phase shifter, the attenuation of which controls the amplitude-to-phase sensitivity of the system. Resistor 133 is an additional resistor included in the 90-degree phase-shifting circuit to counteract the effect of the inductance of the wire-wound power resistors 134–135 which, during active operation of the torpedo panel, performs the additional function of absorbing the power introduced into the system by the torpedo transmitter. Inductances 136-137-138-139, resistors 141-142-143-144, and resistors 134–135 are selected such that the system simulates the impedance of the torpedo transducer under both receiving and transmitting conditions, inductances 136–139 and resistors 141–144 providing the proper output impedance of the artificial transducer and resistors 134–135 providing the proper load for the torpedo-borne transmitter. Adjustment of the amplitudes of the signals applied to terminals L, D, R, and U by means of switches S101 and S102, while maintaining a certain specified amplitude relationship among them, changes the phases of the four output signals applied to the receiver being tested. For example, the differential voltages applied to the input terminals L, D, R, and U in FIG. 6 correspond in sense to the differentials obtained at the bridge terminals of a torpedo receiver input network. That is, for example, voltage differentials applied to terminals L and R with equal voltages on the terminals D and U cause the output signals of the artificial transducer to be of such phase that azimuth steering differentials are generated in the torpedo receiver. Similarly, voltage differentials applied to terminals D and U with equal voltages applied to terminals L and R cause vertical steering differentials to appear in the torpedo receiver. It is important to note, and is here emphasized, that in each case, to simulate an actual transducer, the pair of voltages which are equal must be set equal to the arithmetic mean of the pair which are unequal. Simultaneous application of the proper voltage differentials to both pairs of terminals, as indicated hereinabove, will, of course, cause both vertical and azimuth steering differentials to appear in the receiver.

Switch S102 comprised of switches S102 A-B-C-D of the orientation control circuit is provided with a HORIZONTAL POSITION, RIGHT DIAGONAL POSITION, VERTICAL POSITION, AND LEFT DIAGONAL POSITION, (see FIG. 6) and switch S101 comprised of switches S101 A-B allows selection of target angles at any one position of from 0 to ±6 degrees. Although these controls produce slight amplitude inequalities of the four output signals of the artificial transducer, they have no effect on the average amplitude of the four output signals as this average level is controlled only by the signal level applied to the input terminals. Inasmuch as the artificial transducer contains only low-impedance passive elements, a noise level is available at the output terminals of the artificial transducer of below −130 dbv. Additionally, the frequency response of the system is flat over a relatively wide range, so that the pure-tone frequency to be used with it is not critical, but it is to be noted that noise can be used only if the desired bandwidth is produced prior to the artificial transducer.

With specific reference now to FIG. 6, the output signal of the echo-reverberation channel is supplied through conductors 163–164 to the input terminal G of the phase-shifter circuit and the adjustable arm of switch S101A, the adjustable arm of switch S101B being mechanically connected or ganged to the adjustable arm of switch S101A as shown in FIG. 6 and grounded. The right half portion of switch S101A comprised of series-connected resistors and the left half portion of switch S101B comprised of series-connected resistors are connected to the end terminals 145-146-147-148 of four separate series-resistance circuits 149-151-152-153 comprising ganged switches S102A, S102B, S102C, S102D, and the resistors associated therewith, and the right half of switch S101B comprised of series-connected resistors and the left half of switch S101A comprised of series-connected resistors are connected together and to the opposite end terminals 154-155-156-157 of the aforementioned separate series-resistance circuits.

The adjustable arms of each portion of switch S102 are ganged and adapted to provide different electrical connections or positions in each separate series-resistance circuit to form a voltage divider as shown in FIG. 6 and electrical connections respectively with terminals U, D, R, and L of the bridge which is comprised of like resistors of equal magnitude such as, for example, 47,000 ohms. Terminals A-B of the primary winding of transformer T101 are connected respectively to the bridge electrically midway between terminals D-L and terminals R-U and terminals C-E of the primary winding of transformer T102 are connected respectively to the bridge electrically midway between terminals L-U and terminals D-R.

The output circuit of the artificial transducer is comprised of the secondary windings of transformers T101 and T102 and the resistors 141-142-143-144 and inductances 136-137-138-139 connected in series therewith. As pointed out hereinbefore, the resistors and inductances referred to immediately hereinabove provide an output impedance for the artificial transducer to substantially match the output impedance of the torpedo transducer under receiving conditions. Terminal 5 of the secondary winding of transformer T101 is connected to one terminal 158 of transformer T103 provided with a center-tapped ground connection and terminal 6 of the secondary winding of transformer T102 is connected to the opposite terminal 159 of transformer T103.

To further facilitate understanding of the construction and operation of the artificial transducer, the operation of the artificial transducer will now be discussed in terms of voltages at various points of interest which will be designated by the notations occurring at those points in FIG. 6; e.g., the four input voltages to the bridge are $\underset{\cdot}{V}_L$, $\underset{\cdot}{V}_D$, $\underset{\cdot}{V}_R$, and $\underset{\cdot}{V}_U$, where the dots indicate vectors. If the four input voltages are supplied substantially in the manner shown in FIG. 6, they can be written:

$$\underset{\cdot}{V}_L = V_L \sin \omega t$$

$$\underset{\cdot}{V}_D = V_D \sin \omega t$$

$$\underset{\cdot}{V}_R = V_R \sin \omega t$$

$$\underset{\cdot}{V}_U = V_U \sin \omega t$$

Due to the action of the bridge, the four input voltages to the primary windings of transformers T101 and T102 are, $$\underset{\cdot}{V}_A = V_L + V_D/\alpha \sin \omega t$$

$$\underset{\cdot}{V}_B = V_U + V_R/\alpha \sin \omega t$$

$$\underset{\cdot}{V}_C = V_L + V_U/\alpha \sin \omega t$$

$$\underset{\cdot}{V}_E = V_R + V_D/\alpha \sin \omega t$$

where $\alpha$ is the attenuation of the bridge. If voltage $V_G$ is supplied as shown in FIG. 6 it may be made equal in amplitude to twice the arithmetic mean of voltages $V_A$, $V_B$, $V_C$, and $V_E$ $$\underset{\cdot}{V}_G = (V_U + V_D + V_L + V_R) \sin \omega t$$

The voltages across the primaries of the transformers T101 and T102 are $$\underset{\cdot}{V}_{A\text{-}B} = (V_L + V_D - V_U - V_R) \sin \omega t$$

$$\underset{\cdot}{V}_{C\text{-}E} = (V_L + V_U - V_R - V_D) \sin \omega t$$

From the preceding it may be shown that the voltages from the secondary terminals to their corresponding center tap transformers T101 and T102 are $$V_{.15} = \frac{V_{.A} - V_{.B}}{2n} = \frac{V_L + V_D - V_U - V_R}{2n\,\alpha} \sin \omega t$$

$$V_{.35} = -V_{.15} = \frac{V_U + V_R - V_L - V_D}{2n\,\alpha} \sin \omega t$$

$$V_{.26} = \frac{V_{.C} - V_{.E}}{2n} = \frac{V_L + V_U - V_R - V_D}{2n\,\alpha} \sin \omega t$$

$$V_{.46} = -V_{.26} = \frac{V_R + V_D - V_L - V_U}{2n\,\alpha} \sin \omega t$$

where n is the step-down turns ratio of the transformers T101 and T102. From the action of the 90-degree phase shifter, $$V_{.6} = -V_{.5} = -\frac{V_U + V_D + V_L + V_R}{K\,\alpha} \cos \omega t$$

where K is the attenuation of the phase shifter network. Finally, $$V_{.1} = V_{.15} + V_{.5} = \frac{V_L + V_D - V_U - V_R}{2n\,\alpha} \sin \omega t + \frac{V_U + V_D + V_L + V_R}{K\,\alpha} \cos \omega t$$

$$V_{.2} = V_{.26} + V_{.6} = \frac{V_L + V_U - V_R - V_D}{2n\,\alpha} \sin \omega t - \frac{V_U + V_D + V_L + V_R}{K\,\alpha} \cos \omega t$$

$$V_{.3} = V_{.35} + V_{.5} = \frac{V_U + V_R - V_L - V_D}{2n\,\alpha} \sin \omega t + \frac{V_U + V_D + V_L + V_R}{K\,\alpha} \cos \omega t$$

$$V_{.4} = V_{.46} + V_{.6} = \frac{V_R + V_D - V_L - V_U}{2n\,\alpha} \sin \omega t - \frac{V_U + V_D + V_L + V_R}{K\,\alpha} \cos \omega t$$

Since the resistor and inductor combinations in each of the output lines produces almost no effect on the amplitude and phase relations among the lines $\underset{\cdot}{V}_1$, $\underset{\cdot}{V}_2$, $\underset{\cdot}{V}_3$, $\underset{\cdot}{V}_4$ can be considered the output voltages of the artificial transducer.

Figure 7:
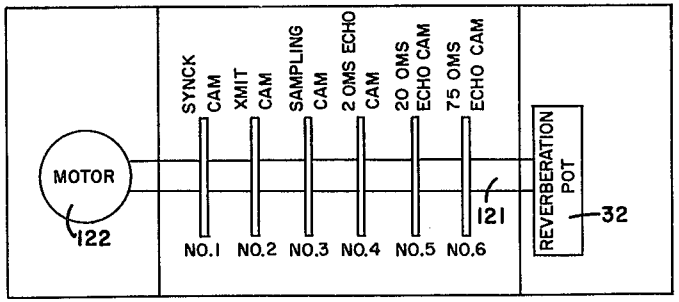
FIG. 7 is a diagrammatic representation of the pulser.

The pulser unit shown diagrammatically in FIG. 7 is comprised of a plurality of cams, (6 in the present case) each adapted to actuate a conventional microswitch at the precise desired time and which are mounted on a common shaft 121 driven by a constant speed motor 122. The reverberation potentiometer 32 such as, for example, a SJ490 Helipot, is also mounted on the shaft 121 to provide the reverberation amplitude-vs-time characteristic which is synchronized with the cyclic operation performed by the microswitches (not shown). It is to be understood that although a rotatable potentiometer has been shown and described, other means such as, for example, a passive RC network or an active network utilizing a vacuum tube may be used to give substantially the same results as the rotatable potentiometer shown and described. The common shaft 121 rotates with a period equal to the listening interval, such as, for example, 1.25 seconds, and each microswitch actuated by its respective cam performs the necessary switching functions during the listening period as described more thoroughly hereinafter, which arrangement necessitates that all cams be timed accurately. The cams in FIG. 7 are given functional designations and are numbered to facilitate reference to and from FIG. 8 and the explanation immediately following.

Figure 8:
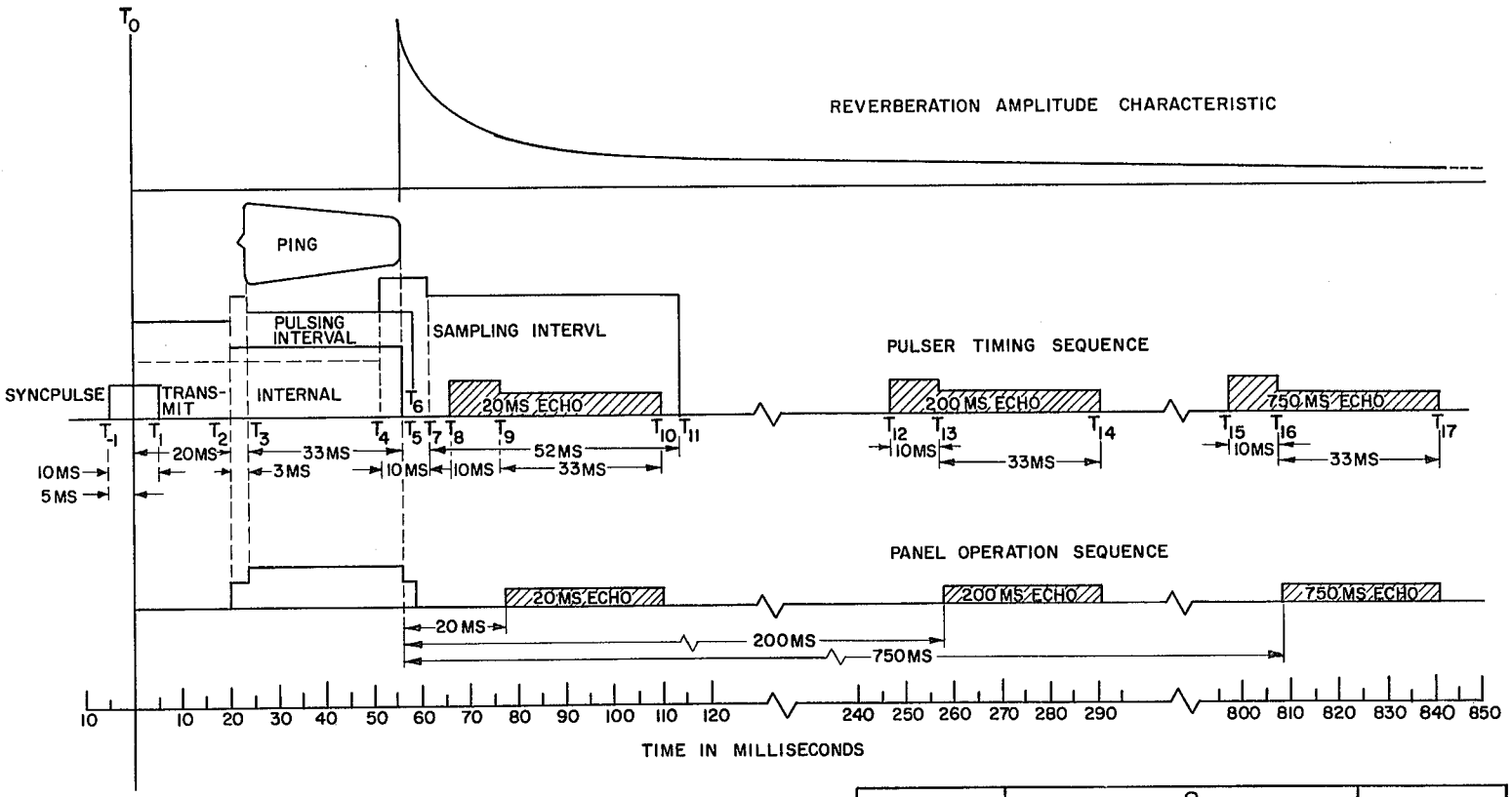
FIG. 8 is a diagram of the sequence of operation of the test set showing the pulse timing sequence and panel operation sequence.

With reference now to FIG. 8, discussion of the operation of the cams and microswitches by way of example and illustration will now be given. The synch-microswitch actuated by cam 1 provides a synch pulse several milliseconds before the leading edge of the transmitter pulse ($T_{-1}$) which is used to trigger the driven sweep of an oscilloscope in order that the envelope of the electronic-panel transmitter pulse ($T_3$ to $T_5$) may be observed if desired.

The transmit microswitch is actuated by cam 2 for a duration of 52 milliseconds ($T_0$ to $T_4$) to obtain operation of the electronic-panel transmitter. When operated by cam 2 the transmit microswitch energizes the necessary relays in the panel to apply high voltages to the transmitter stage, approximately 20 milliseconds ($T_0$ to $T_2$) of the 52 milliseconds being required to close the high voltage relays in the panel, the remaining 32 milliseconds plus 4 milliseconds release time of the high voltage relays representing the time ($T_2$ to $T_5$) that the high voltage relays are closed.

The sampling microswitch actuated by cam 3 is set so that the necessary sampling relays in the electronic-panel are closed for 52±5 milliseconds ($T_7$ to $T_{11}$) shortly after the end of the transmitted pulse. The closing of the sampling microswitch is not critical but the reopening of the sampling relays should occur 62 milliseconds after the transmit microswitch opens. Of the aforementioned 62 millisecond period, four milliseconds ($T_4$ to $T_5$ ) are used by the opening of the panel high-voltage relay, 6 milliseconds ($T_5$ to $T_7$) by part of the closing time of the sampling relays, and 52 milliseconds ($T_7$ to $T_{11}$) by the sampling period.

The twenty-millisecond echo-microswitch actuated by cam 4 must be adjusted to operate for 43 milliseconds ($T_8$ to $T_{10}$). Of this 43 millisecond period, 10 milliseconds ($T_8$ to $T_9$) are required for the closing time of the 20 millisecond echo relay in the signal generator and 33 milliseconds in the desired closed time of the echo relay to simulate an echo and listening period of 33 milliseconds duration ($T_9$ to $T_{10}$). It is preferable that the echo actuated by the 20 millisecond echo-microswitch begin at $T_9$, 20 milliseconds after the end of the transmitted pulse, hence the 20 millisecond microswitch must operate at $T_8$, 10 milliseconds in advance of $T_9$.

The 200 millisecond echo-microswitch actuated by cam 5 is substantially identical with the 20 millisecond echo-microswitch, except that the start of the echo must be at $T_{13}$ 200±10 milliseconds after the end of the transmitted pulse which requires that the 200 millisecond echo-microswitch operate at $T_{12}$, 246±10 milliseconds after the closing of the transmit microswitch by cam 2 at $T_0$.

The 750 millisecond echo-microswitch actuated by cam 6 is substantially identical with the 20 millisecond echo-microswitch, except that the start of the echo must be at $T_{16}$, 750±10 milliseconds after the end of the transmitted pulse which requires that the 750 millisecond echo-microswitch operate at $T_{15}$, 796±10 milliseconds after the closing of the transmit microswitch by cam 2 at $T_0$.

After all of the cams have been aligned substantially in accordance with the description given immediately hereinabove, it being understood that the transmit interval, listening interval, sampling interval, number and time delay of echoes and the like may be varied to meet the requirements of the specific panel or the type of panel being tested, the reverberation potentiometer must be adjusted so that the maximum level of simulated reverberation signal occurs at the end of the transmitted pulse interval.

While the present invention has been described in its preferred embodiment, it is realized that modifications may be made, and it is desired that it be understood that no limitations on this invention are intended other than may be imposed by the scope of the appended claims.

Having now disclosed our invention, what we claim as new and desire to secure by Letters Patent of the United States is:

1. In a device for testing torpedo acoustic homing systems the combination comprising: first means for providing a plurality of output voltages having substantially equal amplitudes and adjustable predetermined relative phase relationships adapted for connection with a torpedo acoustic-homing system; second means for supplying an electrical signal having substantially the same characteristics as an acoustical signal received by an underwater transducer to said first means; and indicating means adapted for monitoring the operation of said homing system whereby the response of said homing system to said output voltages of said first means is pointed out.

2. In a device for testing torpedo acoustic homing systems the combination comprising: first means for providing a torpedo acoustic-homing system a plurality of output voltages having substantially equal amplitudes and adjustable predetermined relative phase relationships, said first means comprising a first circuit for providing four input voltages having adjustable amplitudes and substantially equal phase relationships, a second circuit for providing a fifth input voltage in phase with said four input voltages and having an amplitude substantially equal to a predetermined amount times the arithmetic mean of the said four input voltages, and an output circuit having four output voltages for combining said input voltages whereby a change in the amplitude relationship of said four input voltages results in a change in the phase relationships of said four output voltages; second means for supplying an electrical signal having substantially the same characteristics as an acoustical signal received by an underwater transducer to said first means; and indicating means adapted for monitoring the operation of said homing system whereby the response of said homing system to said output voltages of said first means is pointed out.

3. In a device for testing torpedo acoustic homing systems the combination comprising: first means for providing a torpedo acoustic-homing system a plurality of output voltages having substantially equal amplitudes and adjustable predetermined relative phase relationship; second means for supplying an oscillatory test voltage to said first means; third means for repeatedly attenuating said test voltage rapidly at first and subsequently less rapidly; fourth means for varying the amplitude of said attenuated voltage; fifth means for changing the frequency of said oscillatory test voltage; timing means for actuating said third, fourth, and fifth means whereby the frequency of said test voltage is changed simultaneously with a variation in amplitude of said attenuated test voltage; and indicating means adapted for monitoring the operation of said homing system whereby the response of said homing system to said output voltages of said first means is pointed out.

4. In a device for testing torpedo acoustic homing systems the combination comprising: torpedo transducer simulating means for providing to a torpedo acoustic-homing system a plurality of output voltages having substantially equal amplitudes and adjustable predetermined relative phase relationships; means for supplying an oscillatory test voltage to said transducer simulating means; reverberation simulating means for continuously and repeatedly attenuating said test voltage rapidly at first and subsequently less rapidly; echo simulating means for increasing the amplitude of said attenuated voltage; doppler simulating means for changing the frequency of said oscillatory test voltage; timing means for actuating said echo, doppler, and reverberation simulating means whereby the frequency of said test voltage is changed simultaneously with an increase in amplitude of said attentuated test voltage; and indicating means adapted for monitoring the operation of said homing system whereby the response of said homing system to said output voltages of said transducers emulating means is pointed out.

5. In a device for testing torpedo acoustic homing systems the combination comprising: Means for producing an oscillatory test voltage; reverberation simulating means for continuously attenuating said test voltage at a progressively less rapid rate; echo simulating means for increasing the amplitude of said attenuated voltage; doppler simulating means for changing the frequency of said oscillatory test voltage; timing means for cyclically actuating said echo, doppler, and reverberation simulating means whereby the frequency of said test voltage is changed simultaneously with an increase in amplitude of said attenuated test voltage during an attenuation cycle; means actuated by said attenuated test voltage for providing to a torpedo acoustic-homing system a plurality of output voltages having substantially equal amplitudes and adjustable predetermined relative phase relationships; and indicating means adapted for monitoring the operation of said homing system whereby the response of said homing system to said output voltages of said means actuated by said attenuated test voltages is pointed out.

* * * * *